US011364524B2

(12) United States Patent
Yamashita

(10) Patent No.: US 11,364,524 B2
(45) Date of Patent: Jun. 21, 2022

(54) METHOD FOR PRODUCING H-SHAPED STEEL

(71) Applicant: NIPPON STEEL & SUMITOMO METAL CORPORATION, Tokyo (JP)

(72) Inventor: Hiroshi Yamashita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 693 days.

(21) Appl. No.: 16/322,690

(22) PCT Filed: Dec. 19, 2016

(86) PCT No.: PCT/JP2016/087838
§ 371 (c)(1),
(2) Date: Feb. 1, 2019

(87) PCT Pub. No.: WO2018/029869
PCT Pub. Date: Feb. 15, 2018

(65) Prior Publication Data

US 2021/0370370 A1 Dec. 2, 2021

(30) Foreign Application Priority Data

Aug. 10, 2016 (JP) ..... JP2016-157333

(51) Int. Cl.
*B21B 1/08* (2006.01)
*B21B 1/088* (2006.01)

(52) U.S. Cl.
CPC ..... *B21B 1/088* (2013.01)

(58) Field of Classification Search
CPC ..... B21B 1/088; B21B 1/0815; B21B 1/0886; B21B 1/092; B21B 1/04; B21B 1/06;
(Continued)

(56) References Cited

U.S. PATENT DOCUMENTS 4,295,354 A * 10/1981 Itoh ..... B21B 1/088 72/225
4,402,206 A * 9/1983 Yanazawa ..... D06M 15/673 72/221
(Continued)

FOREIGN PATENT DOCUMENTS

CN 201049378 Y 4/2008
JP 54-43860 A 4/1979
(Continued)

OTHER PUBLICATIONS

English translation of the Written Opinion of the International Searching Authority (form PCT/ISA/237), dated Mar. 7, 2017, for International Application No. PCT/JP2016/087838.
(Continued)

*Primary Examiner* — Debra M Sullivan
(74) *Attorney, Agent, or Firm* — Birch, Stewart, Kolasch & Birch, LLP

(57) ABSTRACT

A method for producing H-shaped steel, the method includes: a rough rolling step; an intermediate rolling step; and a finish rolling step, wherein: the rough rolling step includes: an edging rolling step of rolling and shaping a material to be rolled into a predetermined almost dog-bone shape; and a flat rolling step of performing rolling of a web part with the material to be rolled after completion of the edging rolling step rotated 90° or 270°; upper and lower caliber rolls of at least one caliber of calibers configured to perform the flat rolling step include recessed parts configured to form a raised part at a middle of a web part of the material to be rolled, the recessed parts being provided at roll barrel length middle parts of the upper and lower caliber rolls; and a side surface inclination angle α of the formed raised part is set to 30° or more.

6 Claims, 8 Drawing Sheets

(58) Field of Classification Search
CPC ..... B21B 1/0883; B21B 8/02; B21B 27/02; B21B 27/024; B21B 1/08; B21B 7/024
See application file for complete search history.

(56) References Cited

U.S. PATENT DOCUMENTS

| | | | | | |
|---|---|---|---|---|---|
| 4,637,241 | A | * | 1/1987 | Michaux | B21B 1/14 72/229 |
| 6,055,837 | A | * | 5/2000 | Nishino | B21B 1/0886 72/225 |

FOREIGN PATENT DOCUMENTS

| | | | | | |
|---|---|---|---|---|---|
| JP | 57-146405 | A | | 9/1982 | |
| JP | 57-171501 | A | | 10/1982 | |
| JP | 57193201 | A | * | 11/1982 | B21B 1/088 |
| JP | 59-35802 | A | | 2/1984 | |
| JP | 59-178101 | A | | 10/1984 | |
| JP | 59178101 | A | * | 10/1984 | B21B 1/088 |
| JP | 59212101 | A | * | 12/1984 | B21B 1/088 |
| JP | 60-21101 | A | | 2/1985 | |
| JP | 60021101 | A | * | 2/1985 | B21B 1/088 |
| JP | 60-56401 | A | | 4/1985 | |
| JP | 61-56702 | A | | 3/1986 | |
| JP | 02187201 | A | * | 7/1990 | B21B 1/088 |
| JP | 7-88501 | A | | 4/1995 | |
| JP | 7-265901 | A | | 10/1995 | |
| JP | 2001-137904 | A | | 5/2001 | |

OTHER PUBLICATIONS

Japanese Decision of Final Rejection, dated Jul. 4, 2017, for corresponding Japanese Application No. 2016-157333, with a partial English translation.

Japanese Office Action, dated Mar. 7, 2017, for corresponding Japanese Application No. 2016-157333, with a partial English translation.

Extended European Search Report, dated Jan. 27, 2020, for European Application No. 18812749.5.

Chinese Office Action and Search Report for corresponding Chinese Application No. 201680088260.6, dated Nov. 29, 2019, with partial English translation.

* cited by examiner

METHOD FOR PRODUCING H-SHAPED STEEL

CROSS-REFERENCE TO RELATED APPLICATIONS

This application is based upon and claims the benefit of priority of the prior Japanese Patent Application No. 2016-157333, filed in Japan on Aug. 10, 2016, the entire contents of which are incorporated herein by reference.

TECHNICAL FIELD

The present invention relates to a production method for producing H-shaped steel using, for example, a slab having a rectangular cross section or the like as a raw material.

BACKGROUND ART

In the case of producing H-shaped steel, a raw material such as a slab or a bloom extracted from a heating furnace is shaped into a raw blank (a material to be rolled in a so-called dog-bone shape) by a rough rolling mill (BD). A web and flanges of the raw blank are subjected to reduction in thickness by an intermediate universal rolling mill, and flanges of the material to be rolled are subjected to width reduction and forging and shaping of end surfaces by an edger rolling mill close to the intermediate universal rolling mill. Then, an H-shaped steel product is shaped by a finishing universal rolling mill.

In such a method for producing H-shaped steel, for shaping the raw blank in the so-called dog-bone shape from the slab raw material having a rectangular cross section, there is a known technique of creating splits on slab end surfaces in a first caliber at a rough rolling step, then widening the splits or making the splits deeper in second and subsequent calibers, and eliminating the splits on the slab end surfaces in calibers subsequent thereto (refer to, for example, Patent Document 1).

Besides, in production of the H-shaped steel, it is known that after so-called edging rolling of edging the end surfaces of the raw material such as a slab (slab end surfaces), flat shaping and rolling is performed which rotates the material to be rolled 90° or 270° and performs reduction of a web corresponding part. In this flat shaping and rolling, reduction and shaping of a flange corresponding part is performed together with the reduction of the web corresponding part. In recent years, in consideration that a large-size H-shaped steel product is required, when a large-size raw material is used as a material to be rolled, various problems such as elongation in a web height direction and deformation of the flange corresponding part may arise in general flat shaping and rolling, and correction of the shape is sometimes required. More specifically, there is a concern about a phenomenon that with the reduction of the web corresponding part, the web corresponding part elongates in the longitudinal direction and the flange corresponding part also elongates in the longitudinal direction drawn by the elongation of the web corresponding part, resulting in a decrease in thickness of the flange corresponding part.

Regarding the flat shaping and rolling, for example, Patent Document 2 discloses a technique of selectively performing reduction on the web corresponding part, in which an unreduced part is provided at the middle of the web corresponding part, a formed protruding part (corresponding to a raised part of the present invention) is thereafter eliminated, and the web corresponding part is widened, thereby efficiently producing large-size H-shaped steel. Besides, for example, Patent Document 3 discloses a technique of suitably defining a range of an unreduced part (nonreduced portion) of the web corresponding part and states that the cross-sectional area of the nonreduced portion relative to the whole cross-sectional area of the material to be rolled is set to 0.6 or more.

PRIOR ART DOCUMENT

Patent Document

[Patent Document 1] Japanese Laid-open Patent Publication No. H7-88501
[Patent Document 2] Japanese Laid-open Patent Publication No. S57-146405
[Patent Document 3] Japanese Laid-open Patent Publication No. S57-171501

DISCLOSURE OF THE INVENTION

Problems to be Solved by the Invention

As described above, recently, with an increase in size of structures and the like, production of a large-size H-shaped steel product is desired. In particular, a product having flanges, which greatly contribute to strength and rigidity of H-shaped steel, made wider as compared with conventional ones is desired. To produce the H-shaped steel product with widened flanges, it is necessary to shape a material to be rolled with a flange width larger as compared with a conventional one from the shaping at the rough rolling step.

However, in the technique disclosed, for example, in Patent Document 1, there is a limit in broadening of the flanges in the method of creating the splits on the end surfaces of the raw material such as a slab (slab end surfaces) and edging the end surfaces, and performing the rough rolling utilizing the width spread. In other words, in order to broaden the flanges in conventional rough rolling methods, techniques such as wedge designing (designing of a split angle), reduction adjustment, and lubrication adjustment are used to improve the width spread. However, it is known that since none of the methods greatly contributes to a flange width, the rate of width spread, which represents the rate of a spread amount of the flange width to an edging amount, is approximately 0.8 even under a condition that the efficiency at the initial stage of edging is the highest, decreases as the spread amount of the flange width increases under a condition that edging is repeated in the same caliber, and finally becomes approximately 0.5. It is also conceivable to increase the size of the raw material such as a slab itself to increase the edging amount, but there are circumstances where sufficient broadening of product flanges is not realized because there are device limits in facility scale, reduction amount and so on of the rough rolling mill.

Further, when producing the large-size H-shaped steel product, a large-size raw blank is sometimes rolled and shaped in the rough rolling step. In the case of rolling and shaping the large-size raw blank in a method different from the conventional one and shaping the shape of the raw blank into a shape closer to the H-shaped steel, it is known that there arise problems such as elongation in a web height direction and deformation of a flange corresponding part when the flat shaping and rolling is performed by the techniques disclosed in the above Patent Documents 2, 3.

For example, Patent Document 3 focuses attention only on the rolling effect by the caliber rolling itself when the unreduced part (nonreduced portion) is provided in the web corresponding part, and discloses the conditions that the flange thickness decrease never occurs in the deformation in the caliber. However, in an actual work, the unreduced part other than the portion selectively reduced needs to be eliminated (reduced) at the subsequent process, and it is considered that the flange thickness decrease needs to be evaluated in a final cross-sectional shape after undergoing the subsequent process.

In consideration of the above points, the present inventors evaluated in the whole comprehensive process including the elimination of the unreduced part in the subsequent process. More specifically, the present inventors have found that, as explained in a later-described embodiment of the present invention, the width of the unreduced part is set to a width of 30% or more and 50% or less of a web part inner size of the material to be rolled, for example, when a 300 thick slab is used as a raw material to increase the generation efficiency of the flange, and reached the present invention.

In consideration of the above circumstances, an object of the present invention is to provide a technique for producing H-shaped steel capable of, in a rough rolling step using a caliber when producing H-shaped steel, creating deep splits on end surfaces of a rectangular cross-section raw material such as a slab using projections in acute-angle tip shapes, and sequentially bending flange parts formed by the splits to prevent a shape defect from occurring in the material to be rolled, thereby efficiently and stably producing an H-shaped steel product having a larger flange width as compared with a conventional one.

Another object is to provide a technique of, in the case of rolling and shaping a raw blank in a shape different from a conventional one in flat shaping and rolling implemented after edging rolling, of performing flat shaping and rolling of a large-size raw blank without bringing about problems such as elongation in a web height direction and deformation of a flange corresponding part, thereby efficiently and stably producing an H-shaped steel product having a larger flange width as compared with the conventional one.

Means for Solving the Problems

To achieve the above object, according to the present invention, there is provided a method for producing H-shaped steel, the method including: a rough rolling step; an intermediate rolling step; and a finish rolling step, wherein: the rough rolling step includes: an edging rolling step of rolling and shaping a material to be rolled into a predetermined almost dog-bone shape; and a flat rolling step of performing rolling of a web part with the material to be rolled after completion of the edging rolling step rotated 90° or 270°; upper and lower caliber rolls of at least one caliber of calibers configured to perform the flat rolling step include recessed parts configured to form a raised part at a middle of a web part of the material to be rolled, the recessed parts being provided at roll barrel length middle parts of the upper and lower caliber rolls; and a side surface inclination angle $\alpha$ of the formed raised part is set to 30° or more.

The calibers configured to perform the flat rolling step may further include a raised part eliminating caliber configured to reduce the raised part and roll and shape the web part almost flat, for the material to be rolled formed with the raised part.

The calibers configured to perform the flat rolling step may further include one or a plurality of widening calibers configured to perform widening rolling of the web part concurrently with the web part being rolled and shaped almost flat or after the web part is rolled and shaped almost flat in the material to be rolled.

It is also adoptable that a rolling mill configured to perform the rough rolling step is engraved with a plurality of calibers configured to roll and shape the material to be rolled, the number of the plurality of calibers being six or more; shaping in one or a plurality of passes is performed on the material to be rolled in the plurality of calibers; a first caliber and a second caliber of the plurality of calibers are formed with projections configured to create splits vertical to a width direction of the material to be rolled so as to form divided parts at end parts of the material to be rolled; and the calibers after a third caliber except the calibers configured to perform the flat rolling step located at subsequent stages of the plurality of calibers are formed with projections configured to come into contact with the splits and sequentially bend the formed divided parts.

A width of the raised part formed at the flat rolling step may be set to 30% or more and 50% or less of a web inner size of the material to be rolled.

A rectangular cross-section slab having a thickness of 290 mm or more and 310 mm or less may be used as a raw material.

A width of the rectangular cross-section slab may be 2000 mm.

Effect of the Invention

According to the present invention, it becomes possible to, in the rough rolling step using a caliber when producing H-shaped steel, create deep splits on end surfaces of a rectangular cross-section raw material such as a slab using projections in acute-angle tip shapes, and sequentially bend flange parts formed by the splits to prevent a shape defect from occurring in the material to be rolled, thereby efficiently and stably produce an H-shaped steel product having a larger flange width as compared with a conventional one. Further, in the case of rolling and shaping a raw blank in a shape different from the conventional one in flat shaping and rolling, it is possible to perform flat shaping and rolling of a large-size raw blank without bringing about problems such as elongation in a web height direction and deformation of a flange corresponding part.

BEST MODE FOR CARRYING OUT THE INVENTION

Figure 1:
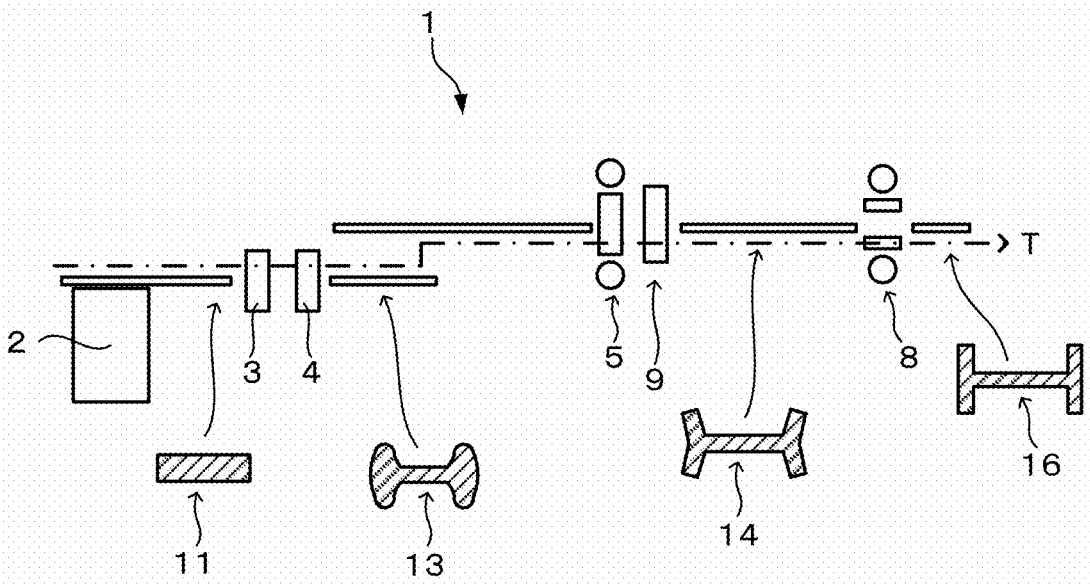
FIG. 1 is a schematic explanatory view about a production line for H-shaped steel.

Hereinafter, an embodiment of the present invention will be explained referring to the drawings. Note that in this description and the drawings, the same codes are given to components having substantially the same functional configurations to omit duplicated explanation.

FIG. 1 is an explanatory view about a production line T for H-shaped steel including a rolling facility 1 according to this embodiment. As illustrated in FIG. 1, in the production line T, a heating furnace 2, a sizing mill 3, a rough rolling mill 4, an intermediate universal rolling mill 5, and a finishing universal rolling mill 8 are arranged in order from the upstream side. Further, an edger rolling mill 9 is provided close to the intermediate universal rolling mill 5. Note that, hereinafter, a steel material in the production line T is collectively described as a "material to be rolled A" for explanation and its shape is appropriately illustrated using broken lines, oblique lines and the like in some cases in the drawings.

As illustrated in FIG. 1, in the production line T, for example, a rectangular cross-section raw material (a later-described material to be rolled A) being a slab 11 extracted from the heating furnace 2 is subjected to rough rolling in the sizing mill 3 and the rough rolling mill 4. Then, the rectangular cross-section raw material is subjected to intermediate rolling in the intermediate universal rolling mill 5. During the intermediate rolling, reduction is performed on a flange tip part (a flange corresponding part 12) of the material to be rolled by the edger rolling mill 9 as necessary. In a normal case, an edging caliber and a so-called flat shaping caliber of thinning a web portion to form the shape of a flange portion are engraved on rolls of the sizing mill 3 and the rough rolling mill 4, and an H-shaped raw blank 13 is shaped by reverse rolling in a plurality of passes through those calibers, and the H-shaped raw blank 13 is subjected to application of reduction in a plurality of passes using a rolling mill train composed of two rolling mills such as the intermediate universal rolling mill 5 and the edger rolling mill 9, whereby an intermediate material 14 is shaped. The intermediate material 14 is subjected to finish rolling into a product shape in the finishing universal rolling mill 8, whereby an H-shaped steel product 16 is produced.

Here, a slab thickness T of the slab 11 extracted from the heating furnace 2 is, for example, within a range of 290 mm or more and 310 mm or less. This is the dimension of a slab raw material called a so-called 300 thick slab used when producing a large-size H-shaped steel product.

Next, caliber configurations and caliber shapes engraved on the sizing mill 3 and the rough rolling mill 4 illustrated in FIG. 1 will be explained below referring to the drawings. FIG. 2 to FIG. 7 are schematic explanatory views about calibers engraved on the sizing mill 3 and the rough rolling mill 4 which perform a rough rolling step. All of a first caliber to a fourth caliber explained herein may be engraved, for example, on the sizing mill 3, or six calibers such as the first caliber to the sixth caliber may be engraved separately on the sizing mill 3 and the rough rolling mill 4. In other words, the first caliber to the sixth caliber may be engraved across both the sizing mill 3 and the rough rolling mill 4, or may be engraved on one of the rolling mills. At the rough rolling step in production of standard H-shaped steel, shaping in one or a plurality of passes is performed in each of the calibers.

Besides, a case where there are six calibers to be engraved will be described as an example in this embodiment, and the number of the calibers does not always need to be six, but may be a plural number such as six or more. For example, a configuration that a general widening rolling caliber is provided at a stage subsequent to a later-described sixth caliber K6 is adoptable. In short, the caliber configuration only needs to be suitable for shaping the H-shaped raw blank 13. Note that in FIG. 2 to FIG. 7, a schematic final pass shape of the material to be rolled A in shaping in each caliber is illustrated by broken lines.

Figure 2:
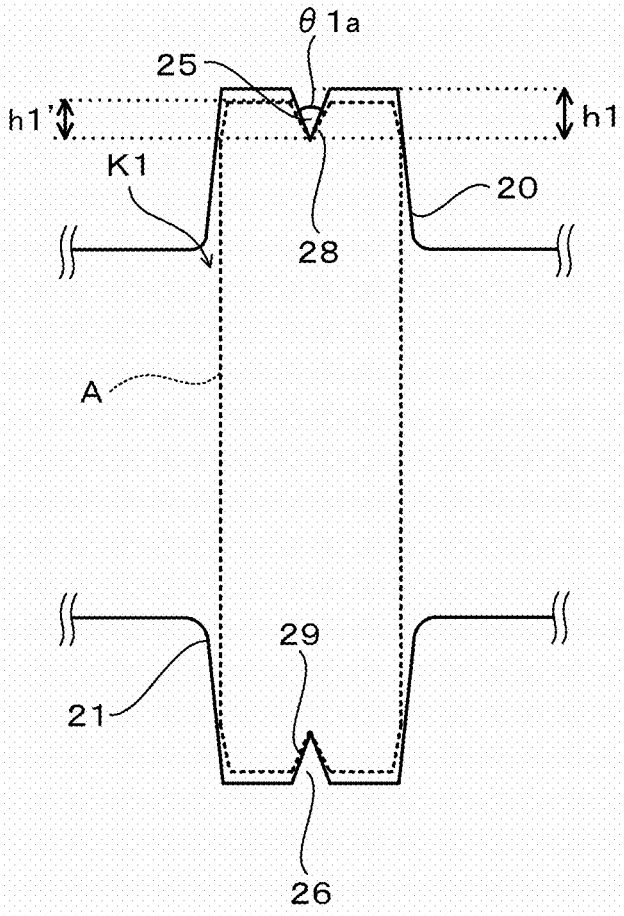
FIG. 2 is a schematic explanatory view of a first caliber.

FIG. 2 is a schematic explanatory view of a first caliber K1. The first caliber K1 is engraved on an upper caliber roll 20 and a lower caliber roll 21 which are a pair of horizontal rolls, and the material to be rolled A is subjected to reduction and shaping in a roll gap between the upper caliber roll 20 and the lower caliber roll 21. Further, a peripheral surface of the upper caliber roll 20 (namely, an upper surface of the first caliber K1) is formed with a projection 25 protruding toward the inside of the caliber. Further, a peripheral surface of the lower caliber roll 21 (namely, a bottom surface of the first caliber K1) is formed with a projection 26 protruding toward the inside of the caliber. These projections 25, 26 have tapered shapes, and dimensions such as a protrusion length of the projection 25 and the projection 26 are configured to be equal to each other. A height (protrusion length) of the projections 25, 26 is h1 and a tip part angle thereof is θ1*a*.

In the first caliber K1, the projections 25, 26 are pressed against upper and lower end parts (slab end surfaces) of the material to be rolled A and thereby form splits 28, 29. Here, a tip part angle (also called a wedge angle) θ1*a* of the projections 25, 26 is desirably, for example, 25° or more and 40° or less.

Here, a caliber width of the first caliber K1 is preferably substantially equal to the thickness of the material to be rolled A (namely, a slab thickness). Specifically, when the width of the caliber at the tip parts of the projections 25, 26 formed in the first caliber K1 is set to be the same as the slab thickness, a right-left centering property of the material to be rolled A is suitably secured. Further, it is preferable that such a configuration of the caliber dimension brings the projections 25, 26 and parts of caliber side surfaces (side walls) into contact with the material to be rolled A at upper and lower end parts (slab end surfaces) of the material to be rolled A during shaping in the first caliber K1 as illustrated in FIG. 2 so as to prevent active reduction at the upper surface and the bottom surface of the first caliber K1 from being performed on the slab upper and lower end parts divided into four elements (parts) by the splits 28, 29. This is because the reduction by the upper surface and the bottom surface of the caliber causes elongation of the material to be rolled A in the longitudinal direction to decrease the generation efficiency of the flanges (later-described flange parts 80). In other words, in the first caliber K1, a reduction amount at the projections 25, 26 (reduction amount at wedge tips) at the time when the projections 25, 26 are pressed against the upper and lower end parts (slab end surfaces) of the material to be rolled A to form the splits 28, 29 is made sufficiently larger than a reduction amount at the slab upper and lower end parts (reduction amount at slab end surfaces) and thereby forms the splits 28, 29.

Figure 3:
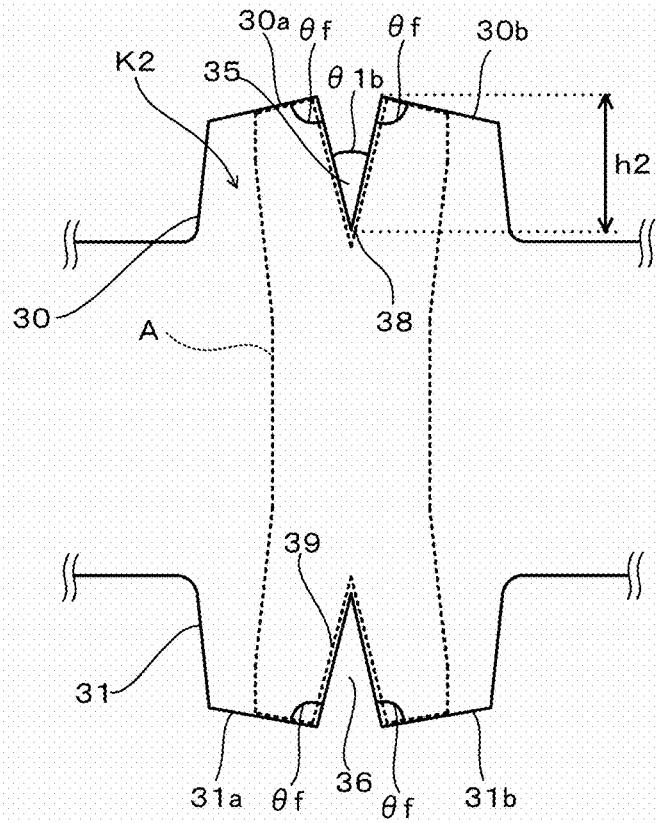
FIG. 3 is a schematic explanatory view of a second caliber.

FIG. 3 is a schematic explanatory view of a second caliber K2. The second caliber K2 is engraved on an upper caliber roll 30 and a lower caliber roll 31 which are a pair of horizontal rolls. A peripheral surface of the upper caliber roll 30 (namely, an upper surface of the second caliber K2) is formed with a projection 35 protruding toward the inside of the caliber. Further, a peripheral surface of the lower caliber roll 31 (namely, a bottom surface of the second caliber K2) is formed with a projection 36 protruding toward the inside of the caliber. These projections 35, 36 have tapered shapes, and dimensions such as a protrusion length of the projection 35 and the projection 36 are configured to be equal to each other. A tip part angle of the projections 35, 36 is desirably a wedge angle θ1*b* of 25° or more and 40° or less.

Note that the wedge angle θ1*a* of the above first caliber K1 is preferably the same angle as the wedge angle θ1*b* of the second caliber K2 at a subsequent stage in order to ensure the thickness of the tip end parts of the flange corresponding parts, enhance inductive property, and secure stability of rolling.

A height (protrusion length) h2 of the projections 35, 36 is configured to be larger than the height h1 of the projections 25, 26 of the first caliber K1 so as to be h2>h1. Further, the tip part angle of the projections 35, 36 is preferably the same as the tip part angle of the projections 25, 26 in the first caliber K1 in terms of rolling dimension accuracy. In a roll gap between the upper caliber roll 30 and the lower caliber roll 31, the material to be rolled A after passing through the first caliber K1 is further shaped.

Here, the height h2 of the projections 35, 36 formed in the second caliber K2 is larger than the height h1 of the projections 25, 26 formed in the first caliber K1, and an intrusion length into the upper and lower end parts (slab end surfaces) of the material to be rolled A is also similarly larger in the second caliber K2. An intrusion depth into the material to be rolled A of the projections 35, 36 in the second caliber K2 is the same as the height h2 of the projections 35, 36. In other words, an intrusion depth h1' into the material to be rolled A of the projections 25, 26 in the first caliber K1 and the intrusion depth h2 into the material to be rolled A of the projections 35, 36 in the second caliber K2 satisfy a relation of h1'<h2.

Further, angles θf formed between caliber upper surfaces 30*a*, 30*b* and caliber bottom surfaces 31*a*, 31*b* facing the upper and lower end parts (slab end surfaces) of the material to be rolled A, and, inclined surfaces of the projections 35, 36, are configured to be about 90° (almost right angle) at all of four locations illustrated in FIG. 3.

Since the intrusion length of the projections at the time when pressed against the upper and lower end parts (slab end surfaces) of the material to be rolled A is large as illustrated in FIG. 3, shaping is performed to make the splits 28, 29 formed in the first caliber K1 deeper in the second caliber K2 to thereby form the splits 38, 39. Note that based on the dimensions of the splits 38, 39 formed here, a flange half-width at the end of a flange shaping step at the rough rolling step is decided.

Further, the shaping in the second caliber K2 illustrated in FIG. 3 is performed by multi-pass, and in the multi-pass shaping, active reduction on the material to be rolled A is not performed at the upper and lower end parts (slab end surfaces) of the material to be rolled A. This is because the reduction causes elongation of the material to be rolled A in the longitudinal direction, thereby decreasing the generation efficiency of the flange corresponding parts (corresponding to the later-described flange parts 80).

Figure 4:
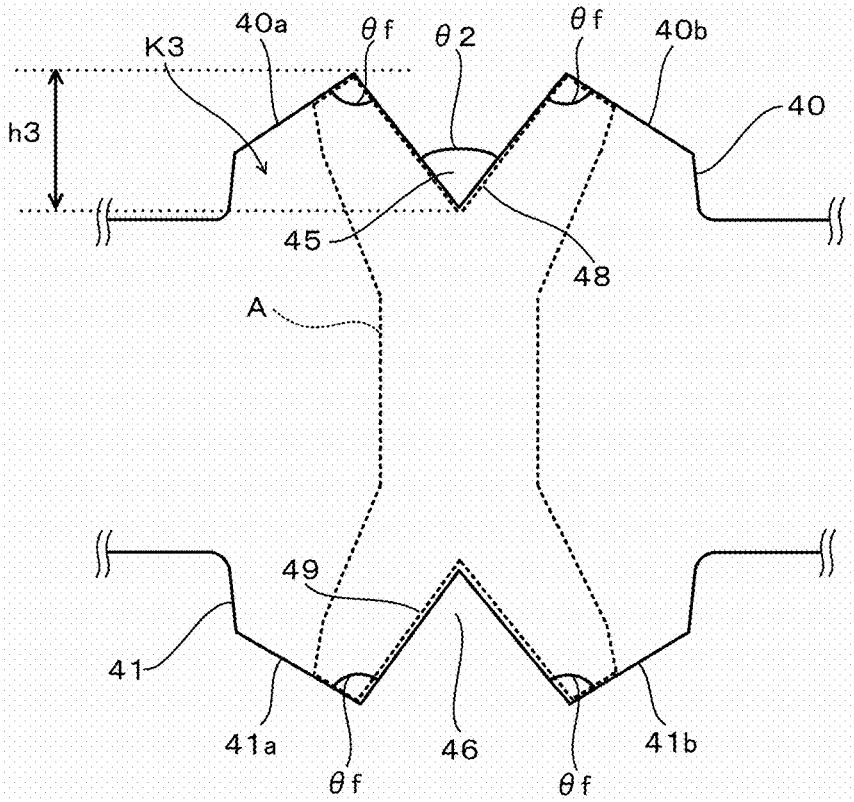
FIG. 4 is a schematic explanatory view of a third caliber.

FIG. 4 is a schematic explanatory view of a third caliber K3. The third caliber K3 is engraved on an upper caliber roll 40 and a lower caliber roll 41 which are a pair of horizontal rolls. A peripheral surface of the upper caliber roll 40 (namely, an upper surface of the third caliber K3) is formed with a projection 45 protruding toward the inside of the caliber. Further, a peripheral surface of the lower caliber roll 41 (namely, a bottom surface of the third caliber K3) is formed with a projection 46 protruding toward the inside of the caliber. These projections 45, 46 have tapered shapes, and dimensions such as a protrusion length of the projection 45 and the projection 46 are configured to be equal to each other.

A tip part angle θ2 of the projections 45, 46 is configured to be larger than the aforementioned angle θ1*b*, and an intrusion depth h3 into the material to be rolled A of the projections 45, 46 is smaller than the intrusion depth h2 of the above projections 35, 36 (namely, h3<h2). The angle θ2 is preferably, for example, 70° or more and 110° or less.

Further, angles θf formed between caliber upper surfaces 40*a*, 40*b* and caliber bottom surfaces 41*a*, 41*b* facing the upper and lower end parts (slab end surfaces) of the material to be rolled A, and, inclined surfaces of the projections 45, 46, are configured to be about 90° (almost right angle) at all of four locations illustrated in FIG. 4.

As illustrated in FIG. 4, in the third caliber K3, the splits 38, 39 formed in the second caliber K2 at the upper and lower end parts (slab end surfaces) of the material to be rolled A after passing through the second caliber K2 become splits 48, 49 by the projections 45, 46 being pressed against thereon. Specifically, in a final pass in shaping in the third caliber K3, a deepest part angle (hereinafter, also called a split angle) of the splits 48, 49 becomes θ2. In other words, shaping is performed so that divided parts (the parts corresponding to the later-described flange parts 80) shaped along with the formation of the splits 38, 39 in the second caliber K2 are bent outward.

Besides, the shaping in the third caliber K3 illustrated in FIG. 4 is performed by at least one pass or more and, in this pass shaping, active reduction of the material to be rolled A is not performed in these passes. This is because the reduction causes elongation of the material to be rolled A in the longitudinal direction, thereby decreasing the generation efficiency of the flange corresponding parts (corresponding to the later-described flange parts 80).

Figure 5:
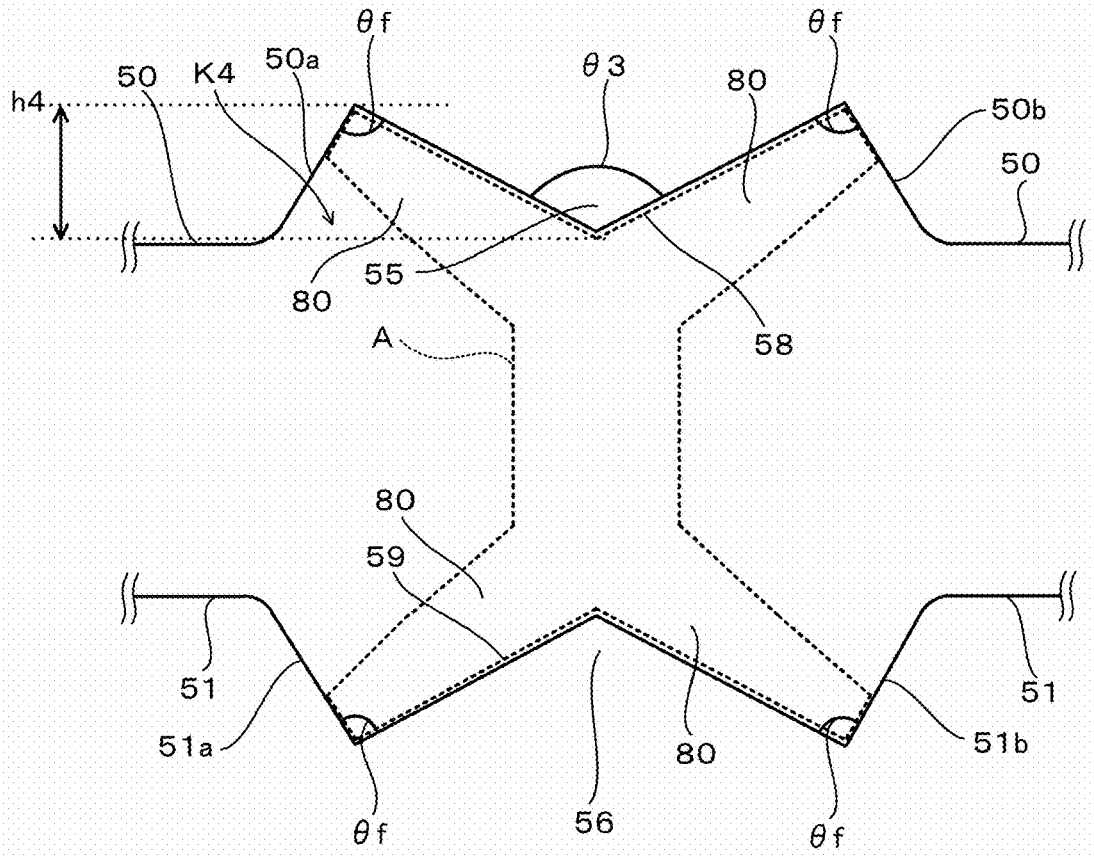
FIG. 5 is a schematic explanatory view of a fourth caliber.

FIG. 5 is a schematic explanatory view of a fourth caliber K4. The fourth caliber K4 is engraved on an upper caliber roll 50 and a lower caliber roll 51 which are a pair of horizontal rolls. A peripheral surface of the upper caliber roll 50 (namely, an upper surface of the fourth caliber K4) is formed with a projection 55 protruding toward the inside of the caliber. Further, a peripheral surface of the lower caliber roll 51 (namely, a bottom surface of the fourth caliber K4) is formed with a projection 56 protruding toward the inside of the caliber. These projections 55, 56 have tapered shapes, and dimensions such as a protrusion length of the projection 55 and the projection 56 are configured to be equal to each other.

A tip part angle θ3 of the projections 55, 56 is configured to be larger than the aforementioned angle θ2, and an intrusion depth h4 into the material to be rolled A of the projections 55, 56 is smaller than the intrusion depth h3 of the projections 45, 46 (namely, h4<h3). The angle θ3 is preferably, for example, 130° or more and 170° or less.

Further, angles θf formed between caliber upper surfaces 50*a*, 50*b* and caliber bottom surfaces 51*a*, 51*b* facing the upper and lower end parts (slab end surfaces) of the material to be rolled A, and, inclined surfaces of the projections 55, 56, are configured to be about 90° (almost right angle) at all of four locations illustrated in FIG. 5 similarly to the above third caliber K3.

In the fourth caliber K4, the splits 48, 49 formed in the third caliber K3 at the upper and lower end parts (slab end surfaces) of the material to be rolled A after passing through the third caliber K3 are pressed to spread by the projections 55, 56 being pressed against thereon, to thereby become splits 58, 59. Specifically, in a final pass in shaping in the fourth caliber K4, a deepest part angle (hereinafter, also called a split angle) of the splits 58, 59 becomes θ3. In other words, shaping is performed so that divided parts (the parts corresponding to the later-described flange parts 80) shaped along with the formation of the splits 48, 49 in the third caliber K3 are further bent outward. The parts of the upper and lower end parts of the material to be rolled A shaped in this manner are parts corresponding to flanges of a later-described H-shaped steel product and called the flange parts 80 herein.

Further, the shaping in the fourth caliber K4 illustrated in FIG. 5 is performed by at least one pass or more, and active reduction of the material to be rolled A is not performed in these passes. This is because the reduction causes elongation of the material to be rolled A in the longitudinal direction, thereby decreasing the generation efficiency of the flange parts 80.

The rolling and shaping using the above first caliber K1 to fourth caliber K4 is also called an edging rolling step of shaping the material to be rolled A into a predetermined almost dog-bone shape and is implemented in a state where the raw material slab having a rectangular cross section is erected.

Figure 6:
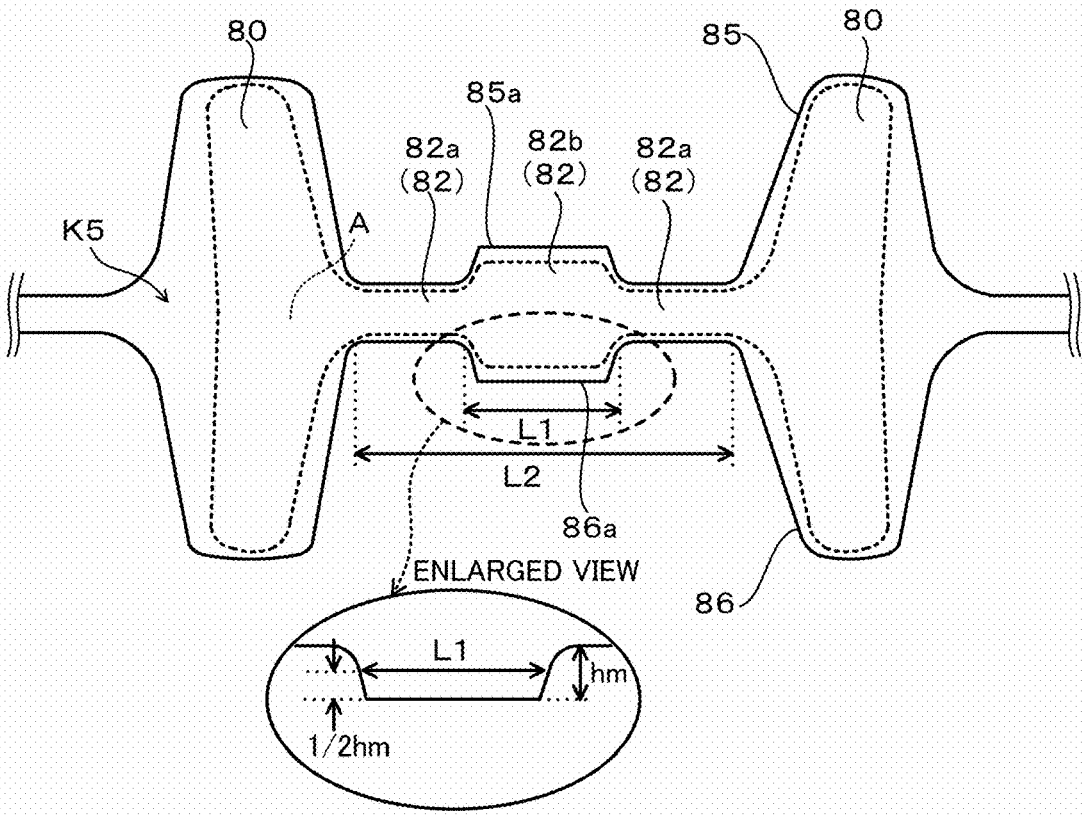
FIG. 6 is a schematic explanatory view of a fifth caliber.

FIG. 6 is a schematic explanatory view of a fifth caliber K5. The fifth caliber K5 is composed of an upper caliber roll 85 and a lower caliber roll 86 which are a pair of horizontal rolls. As illustrated in FIG. 6, in the fifth caliber K5, the material to be rolled A shaped until the fourth caliber K4 is rotated 90° or 270°, whereby the flange parts 80 located at the upper and lower ends of the material to be rolled A until the fourth caliber K4 are located on a rolling pitch line. Then, in the fifth caliber K5, reduction of the web part 82 being a connecting part connecting the flange parts 80 at two positions is performed.

Here, upper and lower caliber rolls 85, 86 of the fifth caliber K5 have shapes formed with recessed parts 85*a*, 86*a* of a predetermined length L1 at their roll barrel length middle parts. With the caliber configuration illustrated in FIG. 6, the reduction of the web part 82 is partially performed, so that reduced portions 82*a* at both ends in the web height direction and a raised part 82*b* as an unreduced portion at the middle part thereof are formed in the web part 82 after the reduction. In this manner, the rolling and shaping of forming the raised part 82*b* in the web part 82 is performed in a material to be rolled in a so-called dog-bone shape.

Note that since the rolling and shaping of partially reducing the web part 82 to form the raised part 82*b* is implemented in the fifth caliber K5, this caliber is called also as a "web partial rolling caliber". Further, the same length as the width length of the raised part 82*b* after the formation is the same length (a later-described escaping amount L1) as the width length L1 of the recessed parts 85*a*, 86*a*. Herein, as illustrated in the enlarged view in FIG. 6, the width length L1 of the recessed parts 85*a*, 86*a* in this description is defined as a width length at a depth of ½ of a depth hm of the recessed parts 85*a*, 86*a*, and the later-described escaping amount L1 is also based on the same definition.

Figure 7:
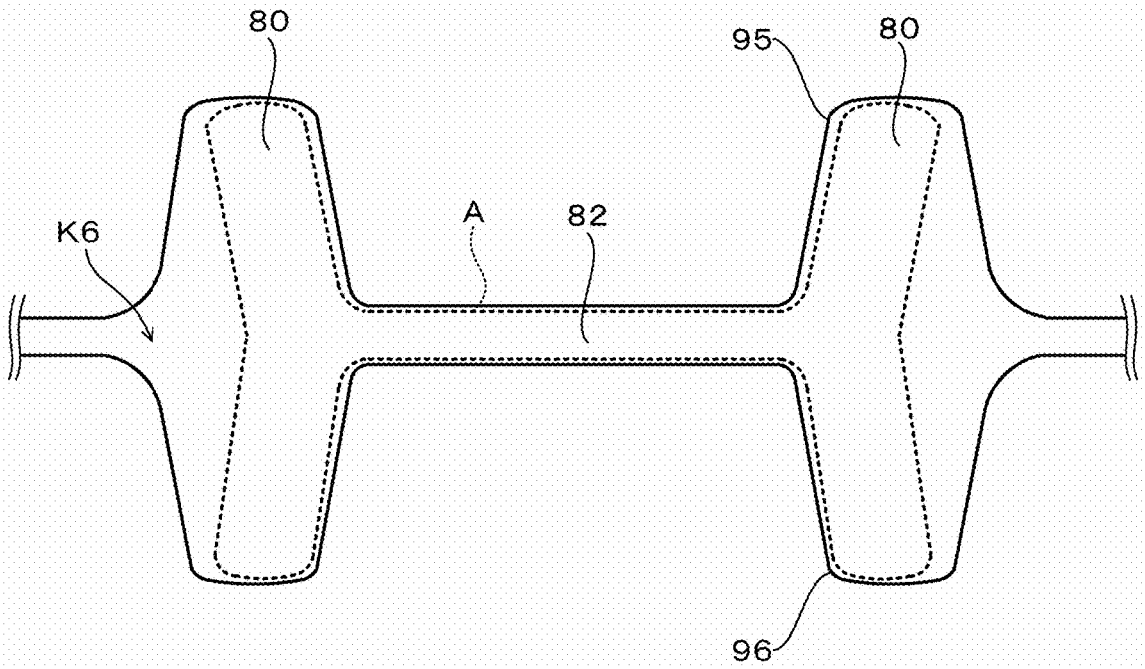
FIG. 7 is a schematic explanatory view of a sixth caliber.

FIG. 7 is a schematic explanatory view of a sixth caliber K6. The sixth caliber K6 is composed of an upper caliber roll 95 and a lower caliber roll 96 which are a pair of horizontal rolls. In the sixth caliber K6, the rolling and shaping of eliminating the raised part 82*b* formed in the web part 82 and widening the inner size of the web part 82 is performed on the material to be rolled A rolled and shaped in the fifth caliber K5.

In the sixth caliber K6, the rolling of bringing the upper and lower caliber rolls 95, 96 into contact with the raised part 82*b* formed in the web part 82 to reduce (eliminate) the raised part 82*b* is performed.

The rolling and shaping by the sixth caliber K6 makes it possible to promote spread in the web height direction and the metal flow to the flange parts 80 accompanying the reduction of the raised part 82*b* to thereby implement the rolling and shaping without causing decrease in area of the flange as much as possible.

The sixth caliber K6 eliminates the raised part 82*b* formed in the web part 82, and is therefore called also as a "raised part eliminating caliber".

Note that regarding the rolling and shaping in the fifth caliber K5 and the sixth caliber K6, their detailed conditions and so on (dimensions, shapes and so on of the calibers) will be described in more detail based on the finding and so on obtained by the present inventors in the explanation of this embodiment.

Further, the material to be rolled A through the first caliber K1 to the sixth caliber K6 described above may be further subjected to the widening rolling of the web part 82 as needed. In this case, at a stage subsequent to the rolling and shaping in the sixth caliber K6, it is only necessary to perform the widening rolling using one or a plurality of widening calibers. Note that since the caliber for the widening rolling in this case is a conventionally known caliber, the explanation of the caliber for the widening rolling is omitted in this description.

The rolling and shaping using the above fifth caliber K5 and sixth caliber K6 (and the widening caliber as needed) is implemented in an almost H-shaped attitude in which the material to be rolled A shaped at the edging rolling step is rotated 90° or 270°, and is therefore called also as a flat rolling step.

The H-shaped steel blank 13 illustrated in FIG. 1 is shaped using the first caliber K1 to the sixth caliber K6 as described above and the caliber for widening rolling as needed. The H-shaped steel blank 13 shaped as described above is subjected to application of reverse rolling in a plurality of passes using the rolling mill train composed of two rolling mills such as the intermediate universal rolling mill 5 and the edger rolling mill 9 being known rolling mills, whereby an intermediate material 14 is shaped. The intermediate material 14 is then subjected to finish rolling into a product shape in the finishing universal rolling mill 8, whereby an H-shaped steel product 16 is produced (see FIG. 1).

In the method for producing H-shaped steel according to this embodiment, the first caliber K1 to the fourth caliber K4 are used to create splits in the upper and lower end parts (slab end surfaces) of the material to be rolled A and perform processing of bending to right and left the portions separated to right and left by the splits to perform the shaping of forming the flange parts 80 as explained above, thereby enabling shaping of the H-shaped raw blank 13 without performing substantial vertical reduction of the upper and lower end surfaces of the material to be rolled A (slab). In short, it becomes possible to shape the H-shaped raw blank 13 having the flange width made wider as compared with the rough rolling method of reducing at all times the slab end surfaces conventionally performed, resulting in production of a final product (H-shaped steel) having a large flange width.

Figure 8:
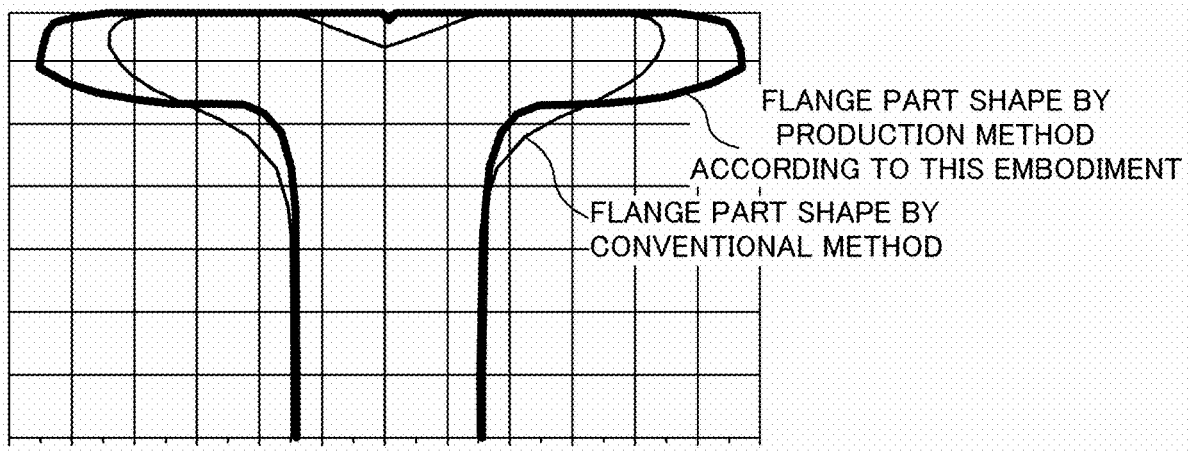
FIG. 8 is an explanatory view of comparing the shape of a flange part after edging rolling in a conventional production method and the shape of a flange part shaped by the first caliber to the fourth caliber according to this embodiment.

Here, in the method for producing H-shaped steel according to this embodiment, the shape of the flange part 80 of the material to be rolled A shaped by the aforementioned first caliber K1 to fourth caliber K4 is a shape closer to the shape of a product flange as compared with the shape of the flange part in the conventional production method. This results from employment of a shaping technique of performing the processing of bending the split parts (the flange parts 80) shaped by creating splits without changing the end part shapes of the raw material (slab) having the rectangular cross section used as the raw material. Note that FIG. 8 is an explanatory view of comparing the shape of the flange part after the edging rolling in the conventional production method and the shape of the flange part 80 shaped by the aforementioned first caliber K1 to fourth caliber K4. It is found also from FIG. 8 that the shape of the flange part shaped by the method for producing H-shaped steel according to this embodiment is a shape closer to the shape of the product flange.

In consideration of the fact that the shape of the flange part 80 shaped as described above is the shape closer to the product flange as compared with the conventional one, the present inventors further carried out a study about preferable conditions of the rolling and shaping in the fifth caliber K5 and preferable conditions of the rolling and shaping in the sixth caliber K6 in this embodiment, and have obtained the knowledge explained below. Hereinafter, the knowledge will be explained referring to the drawings, graphs and so on.

(Side Surface Inclination Angle of Raised Part)

In the fifth caliber K5 (see FIG. 6) according to this embodiment, the raised part 82*b* is formed at the middle of the web part 82 of the material to be rolled A as described above. Then, the formed raised part 82*b* is eliminated in the sixth caliber K6 at the subsequent stage, but a flaw may occur in the web part 82 after the elimination of the raised part due to an overhang or the like of the raised part depending on the shape of the raised part 82*b*. The present inventors considered that the cause of the occurring flaw is attributable to the side surface inclination angle of the raised part 82*b* formed by the rolling and shaping in the fifth caliber K5, and verified the relation between the side surface inclination angle and the raised part reduction amount in eliminating the raised part 82*b* at the time when the side surface inclination angle was changed.

Figure 9:
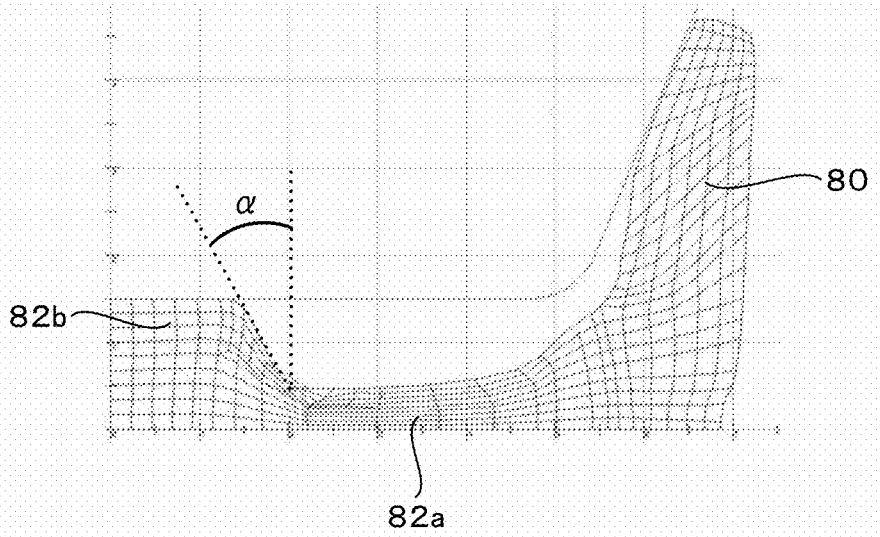
FIG. 9 is a schematic explanatory diagram regarding a side surface inclination angle $\alpha$ of a raised part formed in the fifth caliber.

FIG. 9 is a schematic explanatory diagram regarding a side surface inclination angle α of the raised part 82*b* formed in the fifth caliber K5. Note that FIG. 9 illustrates only a partial cross section (¼ cross section) of the material to be rolled A for simplifying the explanation.

As illustrated in FIG. 9, the side surface inclination angle α of the raised part 82*b* is an angle formed between the direction perpendicular (vertical direction) to the rolling pitch line and the side surface of the raised part 82*b* in the inclined shape as viewed from the rolling direction.

Figure 10:
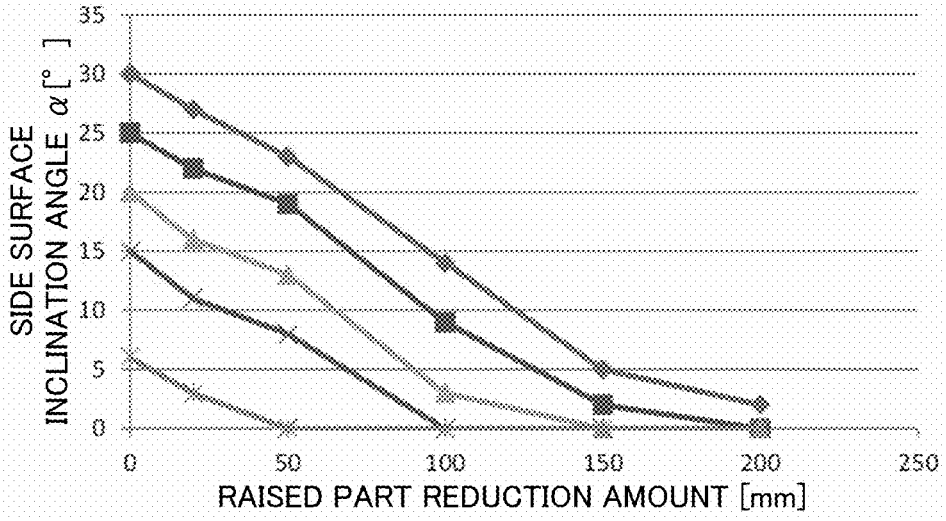
FIG. 10 is a graph indicating the appearance that the side surface inclination angle $\alpha$ of the raised part changes with the reduction of the raised part.

Besides, FIG. 10 is a graph indicating the appearance that the side surface inclination angle α of the raised part 82*b* formed by the rolling and shaping in the fifth caliber K5 changes with the reduction of the raised part 82*b*, and obtained by expressing the appearance that the side surface inclination angle α changes with the increase in raised part reduction amount (namely, the progress of reduction of performing the elimination of the raised part) in a graph. Note that in the graph of FIG. 10, the case where the side surface inclination angle α cannot retain a positive value at the stage where the reduction of the raised part 82*b* proceeds and finishes eliminating the raised part 82*b*, means that a folding flaw occurs after the elimination of the raised part.

As illustrated in FIG. 10, when the side surface inclination angle α of the formed raised part 82*b* is 6°, the side surface inclination angle α is 0° at the stage where the raised part reduction amount becomes 50 mm, and if more reduction is performed, a folding flaw occurs at a boundary part between the raised part 82*b* and the reduced portion 82*a*.

Further, it is found from FIG. 10 that the folding flaw occurs until the raised part reduction amount reaches 200 mm similarly in the case where the side surface inclination angle α is 15°, 20°, 25°.

On the other hand, in the case where the side surface inclination angle α is 30°, the side surface inclination angle α retains a positive value even at the stage where the raised part reduction amount reaches 200 mm, showing that no folding flaw occurs.

In the case of producing a large-size H-shaped steel product having a larger flange width as compared with the conventional one, because a slab raw material having a thickness of 290 mm to 310 mm called a so-called "300 thick slab" is used as a slab raw material, the height of the raised part 82*b* becomes 100 mm at maximum on one side (200 mm at maximum in total of both upper and lower raised parts) when the thickness of the reduced portion 82*a* is set to 100 mm in the rolling and shaping in the fifth caliber K5. In consideration of the above circumstances, it is conceivable that, for example, the raised part reduction amount by the elimination of the raised part 82*b* becomes about 200 mm at maximum in total of upper and lower raised parts, and on that condition, it is preferable to set the side surface inclination angle α of the raised part 82*b* to 30° or more from the result in FIG. 10.

Besides, the upper limit value of the side surface inclination angle α can be arbitrarily set, but an increased side surface inclination angle α affects the height of the raised part 82*b*, possibly failing to obtain a necessary raised part height. Hence, it is desirable to design the setting of the side surface inclination angle α at the level where a necessary raised part height can be obtained in a design range of the raised part forming width explained below, and decide the roll shape.

(Ratio of Escaping Amount (Raised Part Forming Width) in Web Inner Size)

Further, as described above, in the fifth caliber K5 (see FIG. 6) according to this embodiment, the raised part 82*b* is formed at the middle of the web part 82 of the material to be rolled A, and the formed raised part 82*b* is eliminated in the sixth caliber K6 at the subsequent stage. Then, the widening rolling of the web inner size is performed as needed after the elimination of the raised part to thereby shape the H-shaped raw blank, and in order to produce a large-size H-shaped steel product having a larger flange width as compared with the conventional one, it is desirable to make, as large as possible, also the flange width of the H-shaped raw blank.

The present inventors have found that the width length L1 of the raised part 82*b* formed in the fifth caliber K5 (namely, the escaping amount of the web inner size in the rolling and shaping in the fifth caliber K5) is changed to result in a difference in the flange width of the finally obtained H-shaped raw blank. This is attributed to the fact that the flange thickness amount is more easily ensured with an increase in width length of the raised part 82*b* but, on the other hand, the flange width decreases by the drawing action in the longitudinal direction of the material to be rolled A at the time of the subsequent elimination of the raised part Hence, the present inventors verified the relation between the escaping amount of the web inner size (hereinafter, described simply as "escaping amount L1") in the rolling and shaping in the fifth caliber K5 and the flange width of the finally obtained H-shaped raw blank.

Figure 11:
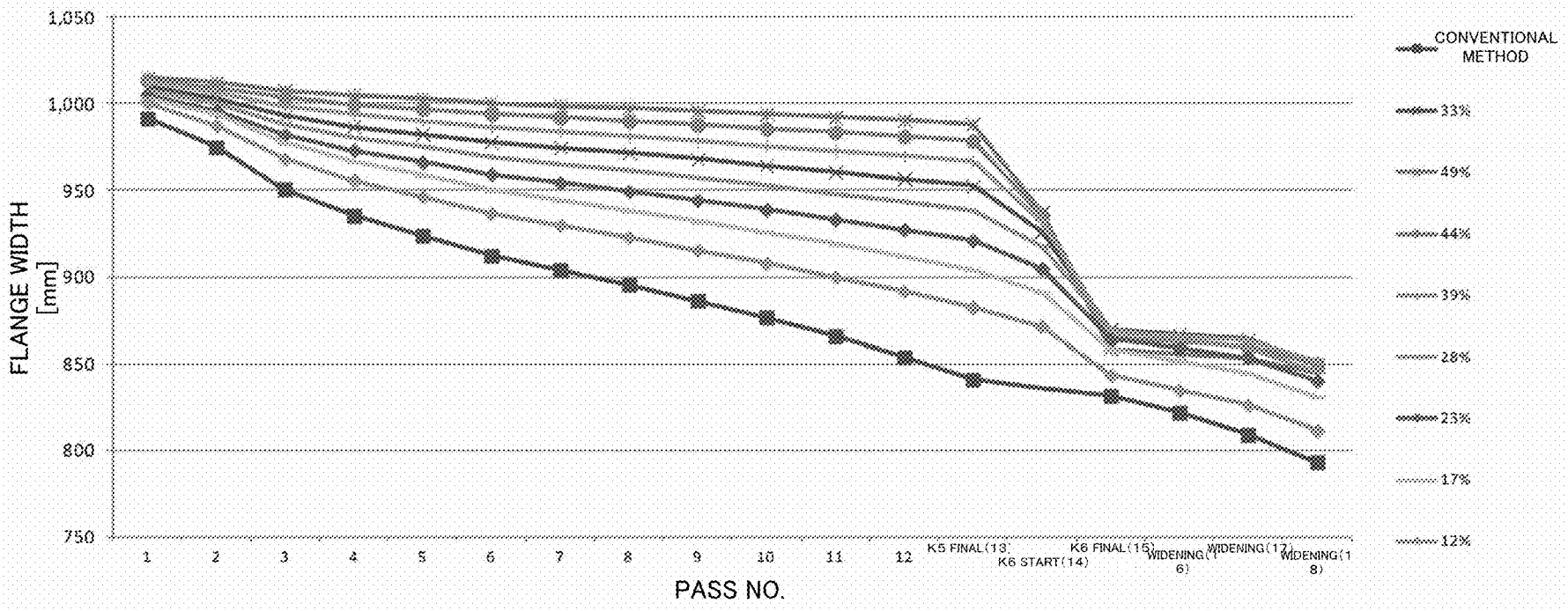
FIG. 11 is a graph indicating changes in flange width in the case where n H-shaped raw blank is shaped by the rolling and shaping in 18 passes in total using the fifth caliber, the sixth caliber, and three widening calibers at subsequent stages.

FIG. 11 is a graph indicating changes in the flange width in the case where the H-shaped raw blank is shaped by the rolling and shaping in 18 passes in total using the fifth caliber K5 and the sixth caliber K6 according to this embodiment, and three more widening calibers at subsequent stages. Note that FIG. 11 is data using a raw material slab having a width of about 2000 mm.

Further, the horizontal axis in the graph of FIG. 11 indicates 1 to 18 passes, 1 to 13 passes of them correspond to the fifth caliber K5, 14, 15 passes correspond to the sixth caliber K6, and 16 to 18 passes correspond to the calibers of the widening rolling performed as needed at subsequent stages.

FIG. 11 further illustrates each data in the case of changing the above escaping amount L1, and the value expressed in the following Expression (1) is defined as an escaping percentage, the cases of escaping percentages of 12%, 17%, 23%, 28%, 33%, 39%, 44%, 49% are indicated, and the case of an escaping percentage of 0% is indicated as the conventional method.

$$\text{Escaping percentage}[\%]=(\text{escaping amount } L1)/\text{web inner size } L2)\times 100 \quad (1)$$

The thickness decrease amount at the flange part 80 in the fifth caliber K5 is decreased by increasing the escaping percentage, so that the flange width of the finally obtained H-shaped raw blank tends to increase together with the increase in escaping percentage as illustrated in FIG. 11. However, by observing the flange width through the elimination of the raised part and the widening rolling in the sixth caliber K6 thereafter, it is found that the flange width does not always increase even if the escaping percentage is increased to a predetermined value or more. This is estimated to be attributed to the increase in the flange thickness decrease amount at the time of the elimination of the raised part in the sixth caliber K6 in the case where an escaping part is made large.

More specifically, it is conceivable that in the case of adopting the method of forming the raised part 82*b* explained in this embodiment as the production process of large-size H-shaped steel, there is a preferable numerical value range of the escaping percentage. Hence, the present inventors focused attention on the relation between the escaping percentage and the increase/decrease of the flange width after the shaping of the H-shaped raw blank, and have drawn the preferable numerical value range of the escaping percentage.

Figure 12:
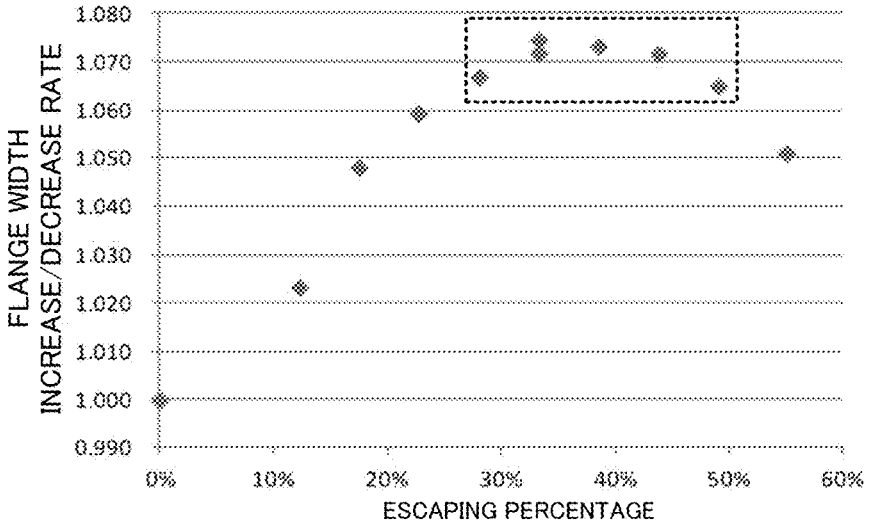
FIG. 12 is a graph indicating the relation between an escaping percentage and a flange width increase/decrease after the shaping of the H-shaped raw blank on the basis of data in FIG. 11.

FIG. 12 is a graph indicating the relation between the escaping percentage and the flange width increase/decrease rate after the shaping of the H-shaped raw blank on the basis of the data in FIG. 11. Note that the flange width increase/decrease rate in FIG. 12 is a value indicating the flange width in the case where the escaping percentage is each value (12% to 55%) using the flange width in the case of the escaping percentage of 0% as a reference (1.000).

As illustrated in FIG. 12, the flange width of the H-shaped raw blank tends to increase with an increase in the escaping percentage, and the flange width increase/decrease indicates an almost fixed value (see a broken line part in the graph) in a region where the escaping percentage is about 30% or more.

In consideration that the rolling and shaping of increasing also the flange width of the H-shaped raw blank is desired in the case of producing a large-size H-shaped steel product having a larger flange width as compared with the conventional one, it is found from the result indicated in FIG. 12 that the numerical value range of the escaping percentage is preferably set to 30% to 50%. Further, from the viewpoints of preventing an increase in rolling load and of increasing the production efficiency in the rolling and shaping process, the escaping percentage is preferably set to a value as low as possible, and therefore it is desirable to set the escaping percentage to about 30%.

According to the above-described method for producing H-shaped steel according to this embodiment, by creating splits in the upper and lower end parts (slab end surfaces) of the material to be rolled A and performing processing of bending to right and left the portions separated to right and left by the splits to perform the shaping of forming the flange parts 80, it is possible to shape the H-shaped raw blank 13 without performing substantial vertical reduction of the upper and lower end surfaces of the material to be rolled A (slab). In short, it becomes possible to shape the H-shaped raw blank 13 with the flange width made wider as compared with the conventionally performed rough rolling method of reducing at all times the slab end surfaces, resulting in production of a final product (H-shaped steel) having a large flange width.

Further, the flat shaping and rolling implemented after the edging rolling is implemented by a caliber configuration including the fifth caliber K5 of forming the raised part 82*b* and the sixth caliber K6 of eliminating the raised part 82*b* and widening the inner size of the web part 82 in this embodiment. This enables rolling and shaping the H-shaped steel blank 13 having the larger flange width as compared with the conventional one and, as a result, enables production of the H-shaped steel product having the larger flange width as compared with the conventional one.

In particular, in producing a large-size H-shaped steel product having a web height of 1000 mm or more and a flange width of 400 mm or more, in the case of rolling and shaping the H-shaped raw blank according to this embodiment using a raw material, a so-called a 300 thick slab, having a thickness of about 300 mm and a width of about 2000 mm, the side surface inclination angle $\alpha$ of the raised part 82*b* formed in the fifth caliber K5 is set to 30° or more and the escaping percentage is set to a range of 30% to 50% (more preferably about 30%) in the formation of the raised part 82*b* as described above, thereby making it possible to maximize the flange width of the H-shaped raw blank to be rolled and shaped.

One example of the embodiment of the present invention has been explained above, but the present invention is not limited to the illustrated embodiment. It should be understood that various changes and modifications are readily apparent to those skilled in the art within the scope of the spirit as set forth in claims, and those should also be covered by the technical scope of the present invention.

For example, the technique of performing the shaping of the material to be rolled A using four calibers such as the first caliber K1 to the fourth caliber K4 and thereafter performing the rolling and shaping of the H-shaped raw blank using the fifth caliber K5, the sixth caliber K6 (and the widening rolling calibers as needed) is explained in the above embodiment, but the number of calibers for performing the rough rolling step is not limited to this, and the rolling and shaping step illustrated in the first caliber K1 to the fourth caliber K4 may be implemented using more calibers. In other words, the caliber configuration illustrated in the above embodiment is an example, and the number of calibers engraved on the sizing mill 3 and the rough rolling mill 4 can be arbitrarily changed and appropriately changed to an extent at which the rough rolling step can be suitably performed.

In the above embodiment, the shaping method of creating splits at the upper and lower end parts (slab end surfaces) of the material to be rolled A and performing processing of bending to right and left the portions separated to right and left by the splits to form the flange parts 80 in the first caliber K1 to the fourth caliber K4 is explained. However, the rolling and shaping technique using the fifth caliber K5 and the sixth caliber K6 according to the present invention is applicable not only to the material to be rolled A shaped by the technique but also, for example, to a conventional H-shaped raw blank (so-called dog-bone material) represented by Patent Document 1.

Example

The shape of the material to be rolled shaped by the rolling and shaping technique according to the present invention as an example of the present invention and the shape of the material to be rolled shaped by the conventionally generally known flat shaping and rolling caliber were compared by simulation analysis, whereby the shapes of the flange parts of the respective materials to be rolled were compared. Note that a so-called 300 thick slab was used as a raw material in this example, and the rolling and shaping was performed with the setting satisfying the conditions (the side surface inclination angle $\alpha$ of 30° or more, the escaping percentage of 30% to 50%) explained in the above embodiment.

Figure 13:
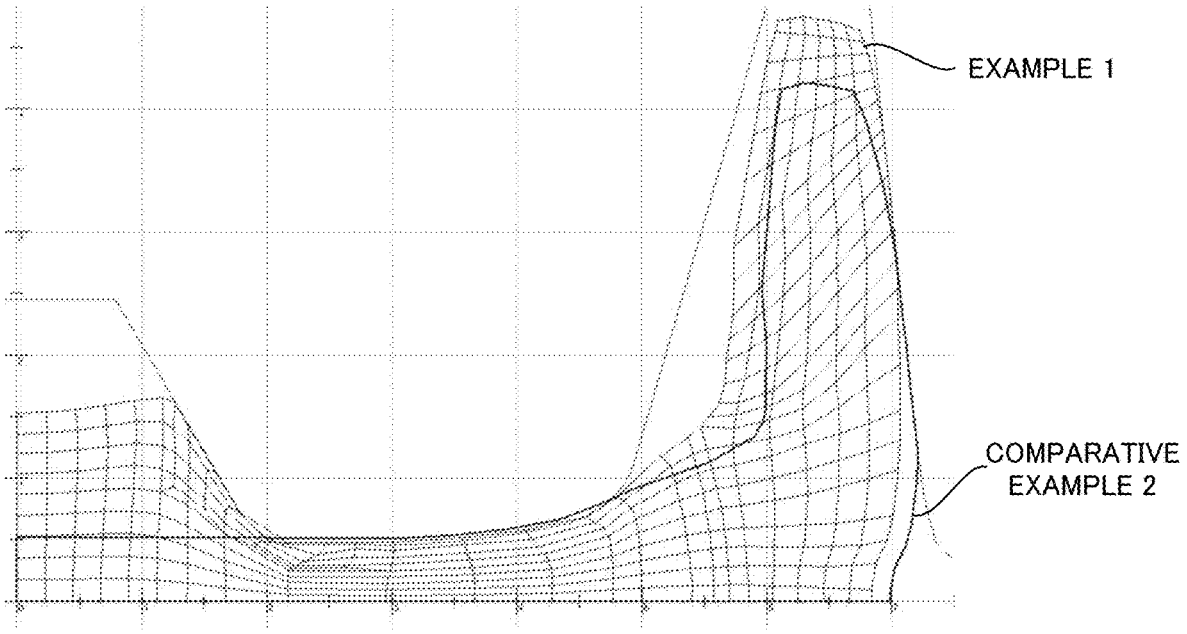
FIG. 13 is a simulation analysis chart schematically illustrating the appearance of the rolling and shaping of a material to be rolled in a web partial rolling caliber.

FIG. 13 is a simulation analysis chart schematically illustrating the appearance of the rolling and shaping of the material to be rolled in the web partial rolling caliber (corresponding to the fifth caliber K5 in the above embodiment) as Example 1. FIG. 13 also illustrates the shape of the material to be rolled after the conventional flat shaping and rolling as Comparative Example 1.

Figure 14:
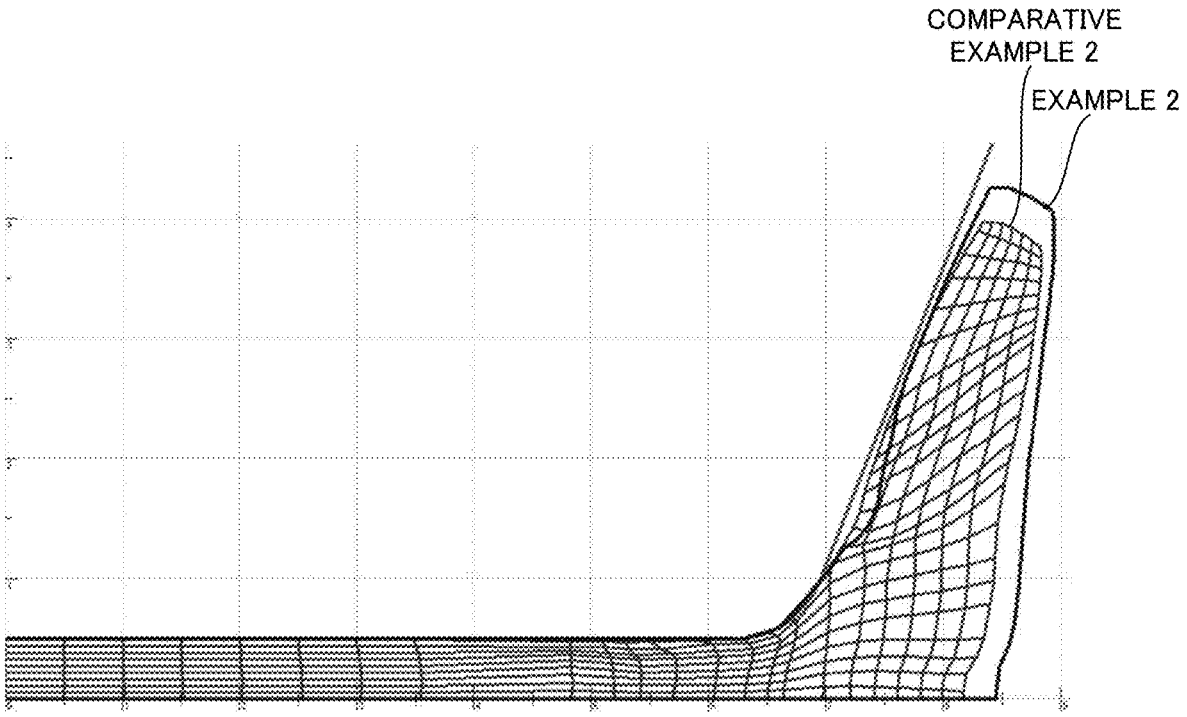
FIG. 14 is a simulation analysis chart schematically illustrating the appearance of the rolling and shaping of the material to be rolled in a raised part eliminating caliber.

Besides, FIG. 14 is a simulation analysis chart schematically illustrating the appearance of the rolling and shaping of the material to be rolled in the raised part eliminating caliber (corresponding to the sixth caliber K6 in the above embodiment) as Example 2. FIG. 14 also illustrates the shape in the case of performing the conventional flat shaping and rolling and thereafter implementing the reduction of the web part in the same caliber as Comparative Example 2.

Note that FIGS. 13, 14 illustrate enlarged ¼ cross sections of the material to be rolled for simplification.

As illustrated in FIG. 13, comparison between Example 1 and Comparative Example 1 shows that there is a large difference in thickness amount of the flange part and the flange width is shaped to be larger, as a matter of course, in Example 1. Further, as illustrated in Example 2 in FIG. 14, the thickness amount of the flange part is not so largely decreased even in the rolling of eliminating the raised part formed in the web, showing that the flange width is retained also at the time of the elimination of the raised part.

Figure 15:
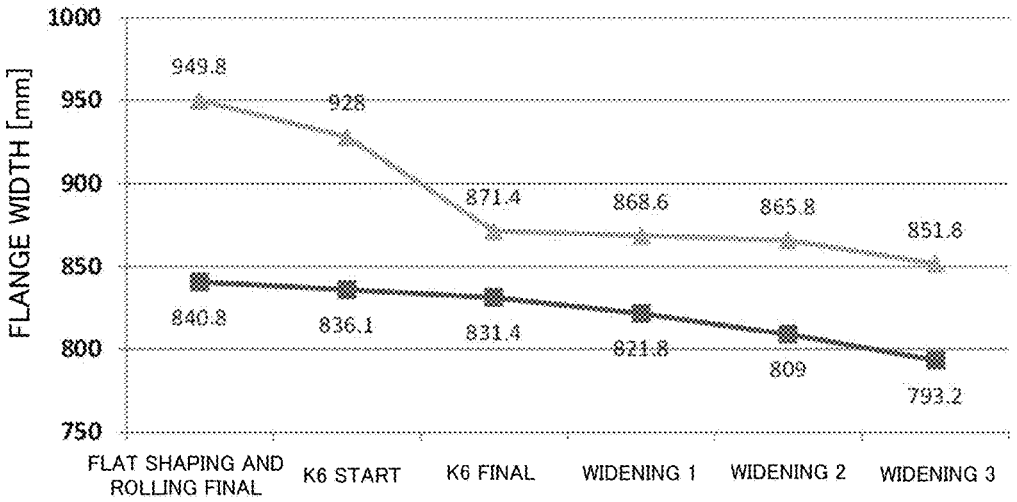
FIG. 15 is a graph indicating changes in the flange width after the flat shaping and rolling when using a 2000 mm wide slab as a raw material.

Besides, FIG. 15 is a graph indicating changes in the flange width after the flat shaping and rolling when using a 2000 mm wide slab as a raw material. FIG. 15 indicates the change in the flange width after the flat shaping and rolling in the case where the conventional flat shaping and rolling was performed (■ in graph), and the change in the flange width after the flat shaping and rolling in the case where the shaping was performed by the rolling and shaping technique according to the present invention (▲ in graph). Note that FIG. 15 illustrates the case where three passes of the widening rolling were performed after the flat shaping and rolling.

As illustrated in FIG. 15, even in the case of using the same 2000 mm width slab as the raw material, the flange width of the material to be rolled finally obtained after the rough rolling in the technique of the present invention is a value larger by about 60 mm than the conventional one. In other words, it is found that the rolling and shaping is performed with the setting satisfying the conditions (the side surface inclination angle $\alpha$ of 30° or more, the escaping percentage of 30% to 50%) explained in the above embodiment, thereby making it possible to shape the flange width of the material to be rolled obtained after the rough rolling larger as compared with the conventional one.

As described above, it is found that an H-shaped raw blank having a larger flange width as compared with the conventional one is shaped in the rolling and shaping of the H-shaped raw blank in the method for producing H-shaped steel according to the present invention. As a result, an H-shaped steel product having a larger flange width as compared with a conventional one is efficiently and stably produced.

INDUSTRIAL APPLICABILITY

The present invention is applicable to a production method for producing H-shaped steel using, for example, a slab having a rectangular cross section or the like as a raw material.

EXPLANATION OF CODES

1 rolling facility
2 heating furnace
3 sizing mill
4 rough rolling mill
5 intermediate universal rolling mill
8 finishing universal rolling mill
9 edger rolling mill
11 slab
13 H-shaped raw blank
14 intermediate material
16 H-shaped steel product
20 upper caliber roll (first caliber)
21 lower caliber roll (first caliber)
25, 26 projection (first caliber)
28, 29 split (first caliber)
30 upper caliber roll (second caliber)
31 lower caliber roll (second caliber)
35, 36 projection (second caliber)
38, 39 split (second caliber)

40 upper caliber roll (third caliber)
41 lower caliber roll (third caliber)
45, 46 projection (third caliber)
48, 49 split (third caliber)
50 upper caliber roll (fourth caliber)
51 lower caliber roll (fourth caliber)
55, 56 projection (fourth caliber)
58, 59 split (fourth caliber)
80 flange part
82 web part
82*a* reduced portion
82*b* raised part (unreduced portion)
85 upper caliber roll (fifth caliber)
85*a* recessed part
86 lower caliber roll (fifth caliber)
86*a* recessed part
95 upper caliber roll (sixth caliber)
96 lower caliber roll (sixth caliber)
K1 first caliber
K2 second caliber
K3 third caliber
K4 fourth caliber
K5 fifth caliber (web partial rolling caliber)
K6 sixth caliber (raised part eliminating caliber)
T production line
A material to be rolled

What is claimed is:

1. A method for producing H-shaped steel from a raw material, the method comprising:

a rough rolling step;

an intermediate rolling step; and a finish rolling step, wherein:

the rough rolling step comprises:

an edging rolling step of rolling and shaping a raw material into a predetermined shape including a web part; and a flat rolling step of rotating the material of the predetermined shape 90° or 270° after completion of the edging rolling step and forming a raised part at a middle of the web part of the material of the predetermined shape using upper and lower caliber rolls having a raised part forming caliber with recessed parts, each of the recessed parts being provided at respective middle parts along a respective roll barrel of the upper and lower caliber rolls; and a side surface inclination angle $\alpha$ formed, during the flat rolling step, between a direction perpendicular to a rolling pitch line and a side surface of the formed raised part as viewed from a rolling direction is set to 30° or more, wherein the flat rolling step further includes reducing the raised part by rolling and shaping the web part flat with a raised part eliminating caliber, and wherein the flat rolling step further includes performing widening rolling of the web part using one or a plurality of widening calibers after the web part is rolled and shaped flat.

2. The method for producing H-shaped steel according to claim 1, wherein:

the rough rolling step is performed with a plurality of calibers, the plurality being six or more and including the raised part forming caliber, the raised part eliminating caliber and the one or plurality of widening calibers;

performing the rough rolling step in one or a plurality of passes on the raw material in the plurality of calibers;

the edging rolling step includes creating splits to form divided parts at ends of the raw material using a first caliber and a second caliber of the plurality of calibers, the first and second calibers having projections perpendicular to a width direction of the raw material; and sequentially bending the formed divided parts by having projections of subsequent calibers of the plurality of calibers, except the calibers performing the flat rolling step, coming into contact with the splits.

3. The method for producing H-shaped steel according to claim 2, wherein a width of the raised part formed at the flat rolling step is set to 30% or more and 50% or less of a width of the web part of the material of the predetermined shape.

4. The method for producing H-shaped steel according to claim 1, wherein a width of the raised part formed at the flat rolling step is set to 30% or more and 50% or less of a width of the web part of the material of the predetermined shape.

5. The method for producing H-shaped steel according to claim 4, wherein the raw material is a rectangular cross-section slab having a width of 2000 mm.

6. The method for producing H-shaped steel according to claim 1, wherein the raw material is a rectangular cross-section slab having a thickness of 290 mm or more and 310 mm or less.

* * * * *